US007708439B2

(12) United States Patent
Naganawa et al.

(10) Patent No.: US 7,708,439 B2
(45) Date of Patent: May 4, 2010

(54) VEHICLE HEADLAMP

(75) Inventors: Masahito Naganawa, Shizuoka (JP); Masao Kinoshita, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 608 days.

(21) Appl. No.: 11/290,426

(22) Filed: Dec. 1, 2005

(65) Prior Publication Data

US 2006/0120096 A1 Jun. 8, 2006

(30) Foreign Application Priority Data

Dec. 3, 2004 (JP) ..... P. 2004-351925

(51) Int. Cl.
*F21V 7/00* (2006.01)
*F21V 17/02* (2006.01)

(52) U.S. Cl. ..... 362/514; 362/507; 362/516; 362/517; 362/538; 362/539; 362/297; 362/298; 362/319; 362/322; 362/346

(58) Field of Classification Search ..... 362/516, 362/514, 512, 539, 297–300, 328, 343, 346, 362/351, 517, 507, 538, 319, 322, 323
See application file for complete search history.

(56) References Cited

U.S. PATENT DOCUMENTS 5,055,981 A * 10/1991 Nino ..... 362/539
6,059,435 A * 5/2000 Hamm et al. ..... 362/514
6,543,910 B2 * 4/2003 Taniuchi et al. ..... 362/297

FOREIGN PATENT DOCUMENTS

JP 5-159603 A 6/1993
JP 2000-215717 A 8/2000
JP 2002-289013 A 10/2002

OTHER PUBLICATIONS

Japanese Notice of Reason of Rejection dated Aug. 11, 2009.

* cited by examiner

*Primary Examiner*—Sharon E Payne
*Assistant Examiner*—Sean P Gramling
(74) *Attorney, Agent, or Firm*—Sughrue Mion, PLLC

(57) ABSTRACT

A vehicle headlamp is provided with a lamp unit including a light source bulb having a light source for emitting light, a main reflector for reflecting the light emitted from the light source, a shade for shielding apart of the light reflected by the main reflecting face, and a projector lens for forward projecting the light having passed the shades. The vehicle headlamp unit is further provided with a first sub-reflector for reflecting the light emitted from the light source, a second sub-reflector for forward projecting the light from the first sub-reflector through the shade and the projector lens when the first sub-reflector is situated at a first position and a third sub-reflector having a third sub-reflecting face for forward projecting the light from the first sub-reflector not through the projector lens when the first sub-reflector is situated at a second position.

10 Claims, 18 Drawing Sheets

VEHICLE HEADLAMP

The present application claims foreign priority based on Japanese Patent Application No. P.2004-351925, filed on Dec. 3, 2004, the contents of which are incorporated herein by reference.

BACKGROUND OF THE INVENTION

1. Field of the Invention

The present invention relates to a vehicle headlamp capable of realizing both suitable change in light quantity of light and a large quantity of light.

2. Related Art

There is a vehicle headlamp for projecting light ahead of the vehicle by using a projector type of lamp unit.

In such a projector type of lamp unit, a light source is arranged in the vicinity on an optical axis extending in a longitudinal direction of the vehicle. Light emitted from the light source is forward collected/reflected toward the optical axis by a reflector. The reflected light by the reflector is projected ahead of the lamp unit through a projector lens arranged in front of the reflector. A shade is arranged in the vicinity of the focal point on the rear side of the projector lens, and a part of the reflected light from the reflector is cut or shielded to form the cut-off line, so that a distributed light pattern having a cut-off line on the upper end face is formed. (See, for example, JP-A-05-159603).

Further, there is a vehicle headlamp called as an AFS (adaptive front lighting system). In the AFS, a position of a movable reflector located within in a lamp unit is appropriately changed to adaptively change a distributed light pattern, so as to realize a distributed light pattern suitable to a vehicle dedicated road (freeway), a distributed light pattern suitable to a bad weather, etc. as required.

In the vehicle headlamp for a lower beam (a passing beam) for forming a lower beam distributed light pattern, it is preferable that the quantity of light below an H line is increased to realize a large quantity of light. However, in such a vehicle headlamp, when it is intended to adaptively change the distributed light pattern, it is difficult to realize the collected light with a sufficient quantity of light. For example, even when it is intended to form the collected light in the vicinity of H-V, the collected light with the sufficient quantity of light cannot be formed.

SUMMARY OF THE INVENTION

One or more embodiments of the present invention provide a vehicle headlamp to realize compatibility between a large quantity of light and collected light, by fully using the quantity of light of a limited light source.

In accordance with one or more embodiments of the present invention, a vehicle headlamp is provided with: a light source bulb having a light source for emitting light; a main reflector that reflects the light emitted from the light source; a shade that shields a part of the light reflected by the main reflector; a projector lens that forward projects the light passing the shade; a first sub-reflector that reflects the light emitted from the light source, the first sub-reflector being movable; a second sub-reflector that forward reflects the light from the first sub-reflector through the shade and the projector lens when the first sub-reflector is located in a first position; and a third sub-reflector that forward projects the light from the first sub-reflector not through the projector lens when the first sub-reflector is located in a second position.

In addition, in accordance with one or more embodiments of the present invention, the vehicle headlamp may further be provided with: a fourth sub-reflector that reflects the light emitted from the light source toward the second sub-reflector, wherein the second sub-reflector forward projects the light from the fourth sub-reflector through the shade and the projector lens.

In addition, in accordance with one or more embodiments of the present invention, in the vehicle headlamp, the shade may change a height of its upper end face according to the position of the first sub-reflector; and the height of the upper end face of the shade may be lower when the first sub-reflector is located in the first position than the height of the upper end face of the shade when the first sub-reflector is located in the second position.

In addition, in accordance with one or more embodiments of the present invention, in the vehicle headlamp, the second sub-reflector may be integrally formed with the main reflector, and the second sub-reflector does not intersect a plane including the light source and a central axis of the projector lens.

In addition, in accordance with one or more embodiments of the present invention, in the vehicle headlamp, the first sub-reflector may be arranged above the horizontal plane including a central axis of the projector lens; and the third sub-reflector may be arranged below the horizontal plane.

In one or more embodiments of the present invention, according to when the light incident on the first sub-reflector is reflected at the first position or at the second position thereof, the region to be illuminated can be changed. Therefore, by forward projecting the light incident on the first sub-reflector as required, a suitable distributed light pattern can be adaptively formed. Concretely, when the first sub-reflector is situated at the first position, collected light is formed and when the first sub-reflector is situated at the second position, diffused light is formed. In this way, as required, the quantity of light below the H line can be increased to realize a large quantity of light or otherwise the collected light with sufficient quantity of light can be collected in the vicinity of the H-V.

Other aspects and advantages of the invention will be apparent from the following description and the appended claims.

DESCRIPTION OF THE PREFERRED EMBODIMENTS

Embodiments of the invention will be described with reference to the accompanying drawings.

Figure 1:
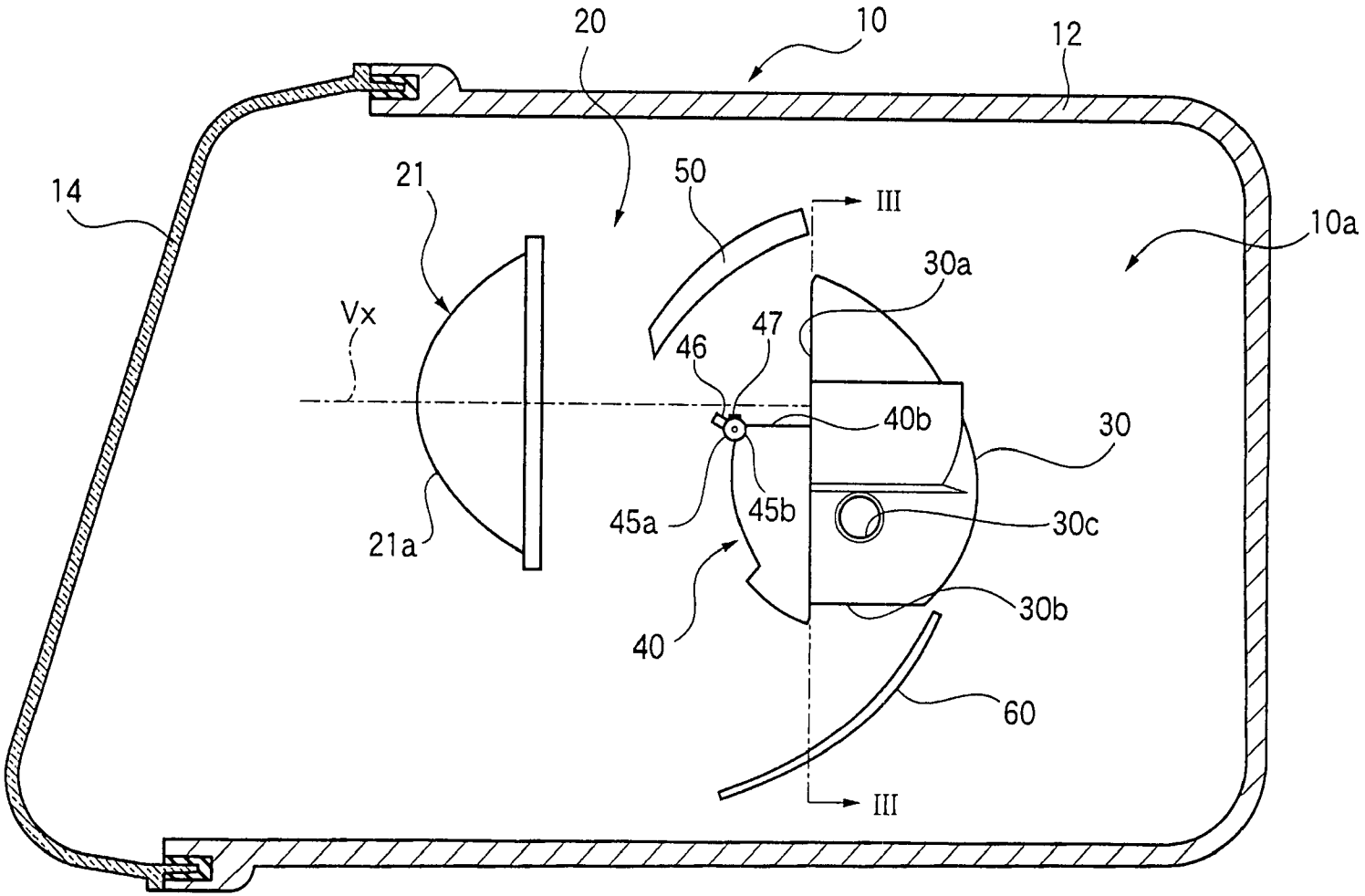
FIG. 1 is a view showing the vehicle headlamp according to an embodiment of this invention.
Figure 2:
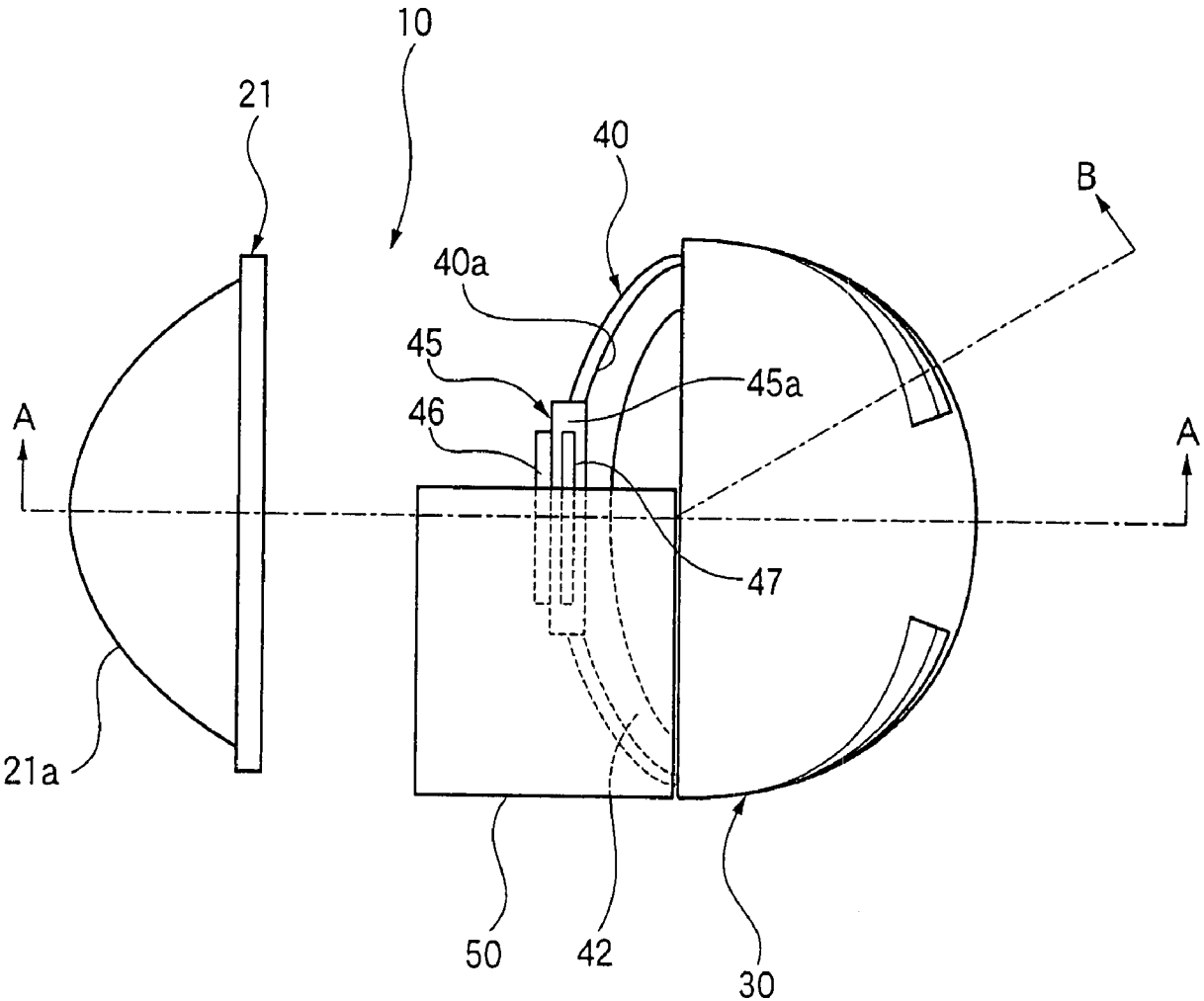
FIG. 2 is a top view of the vehicle.
Figure 3:
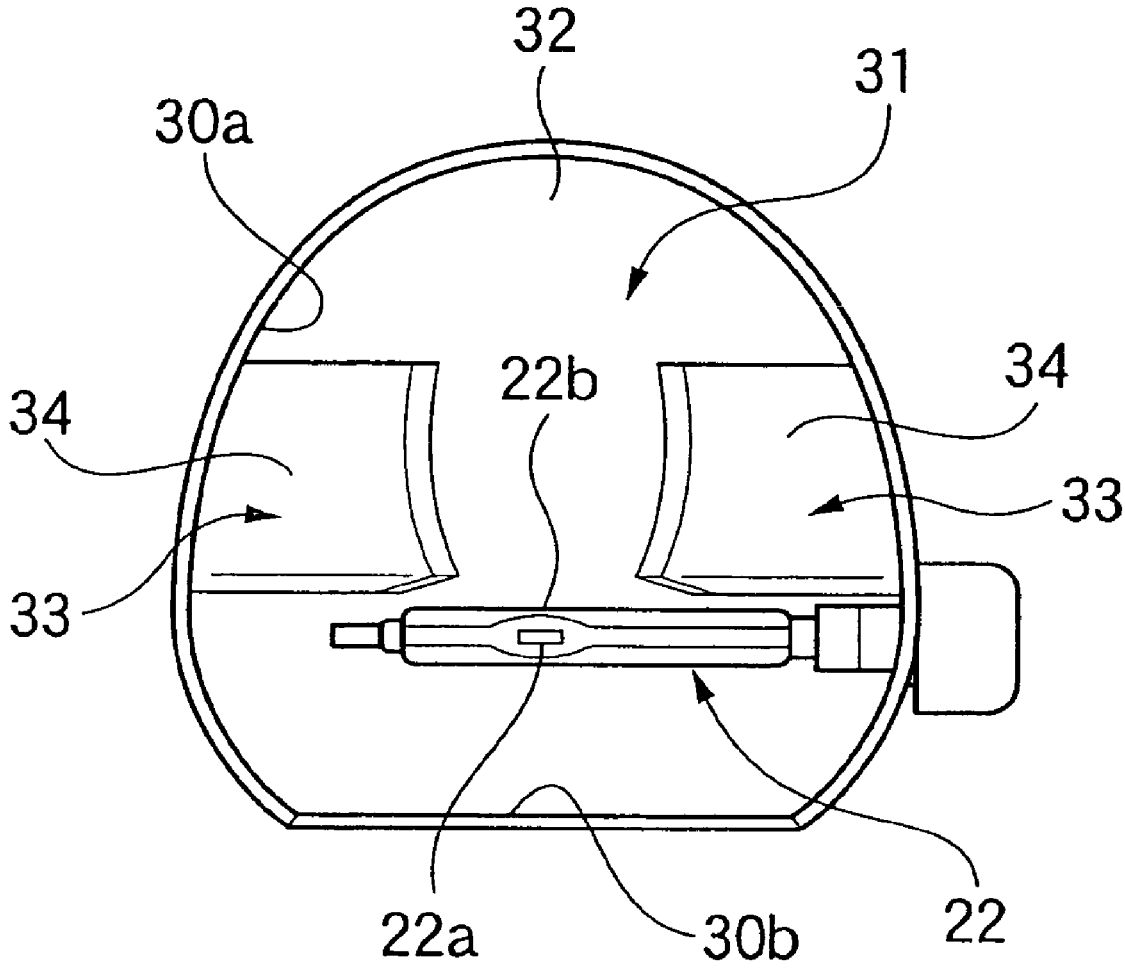
FIG. 3 is a sectional view taken in line III-III in FIG. 1.
Figure 4:
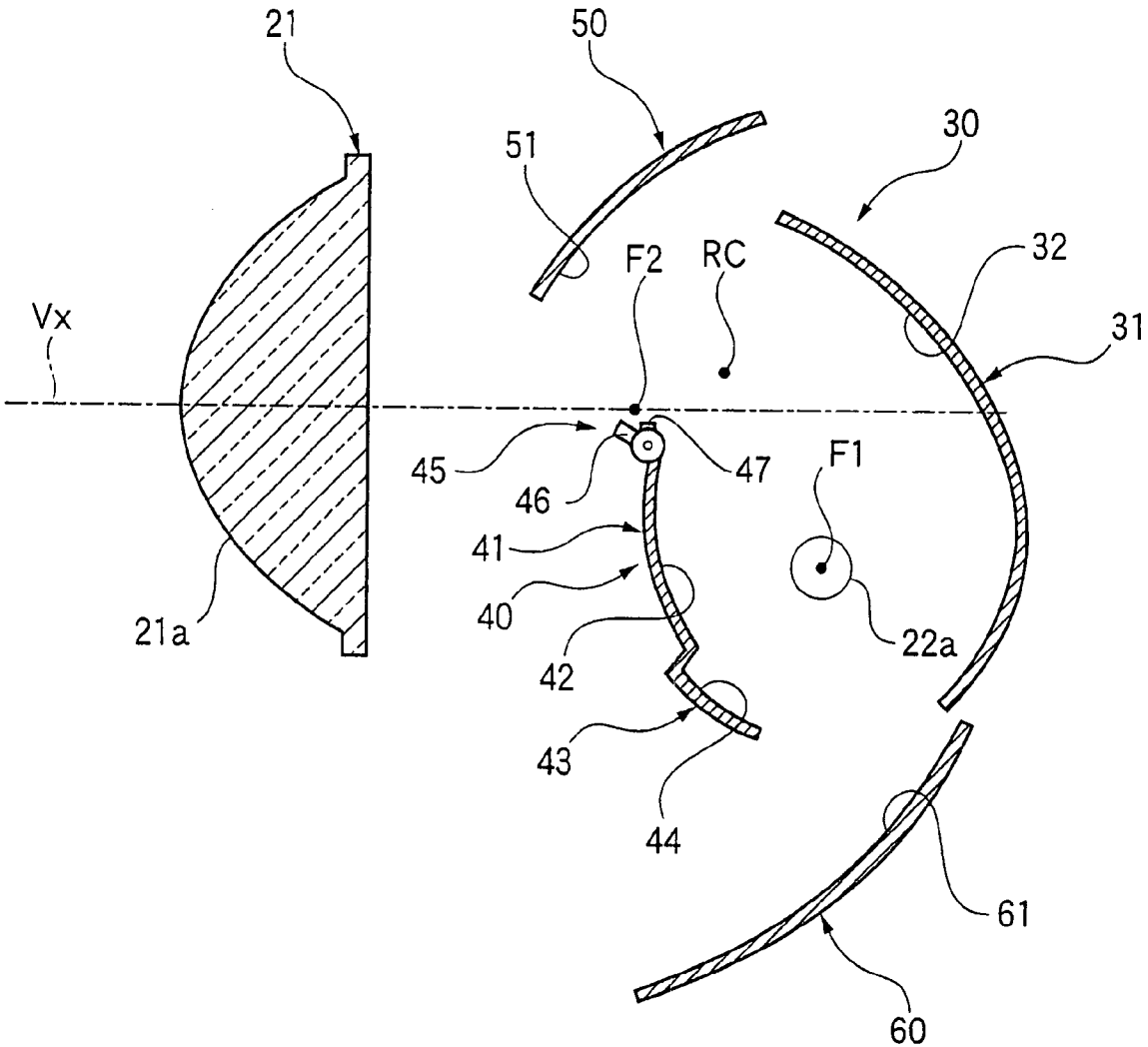
FIG. 4 is a sectional view taken in line A-A in FIG. 2 in a status of shade releasing.
Figure 5:
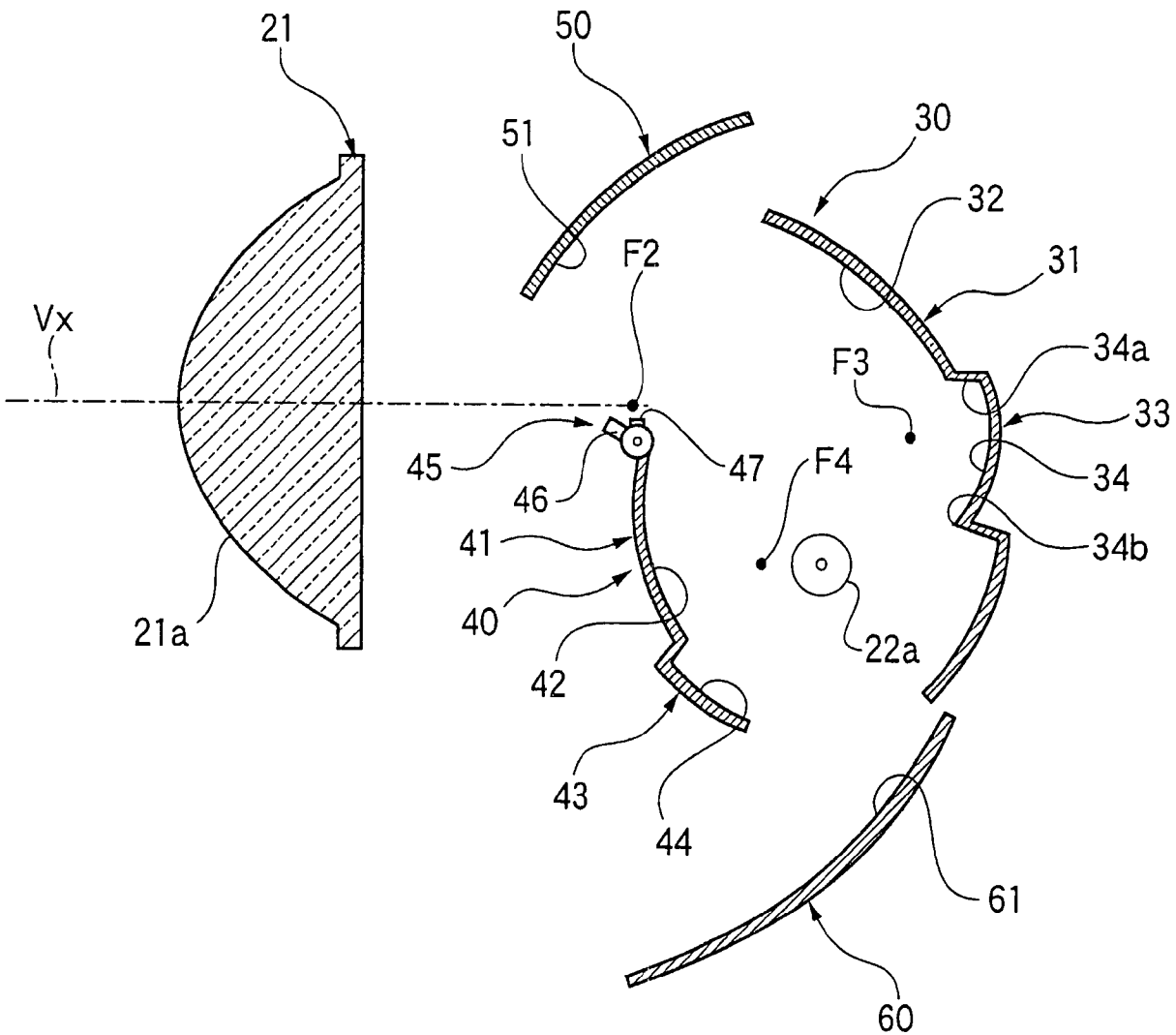
FIG. 5 is a sectional view taken in line A-B in FIG. 2 in a status of shade releasing.
Figure 6:
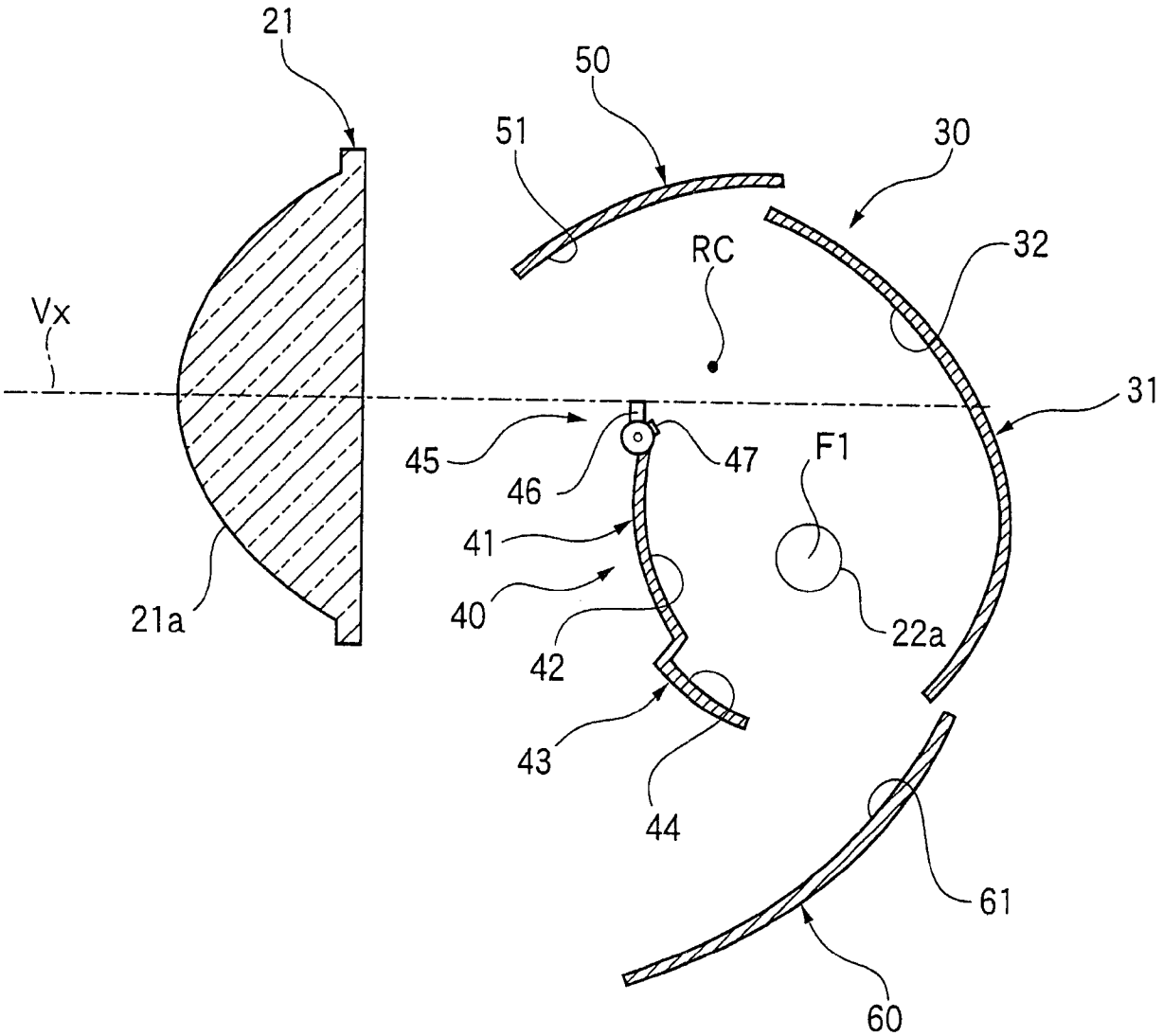
FIG. 6 is a sectional view taken in line A-A in FIG. 2 in a status of shade shielding.
Figure 7:
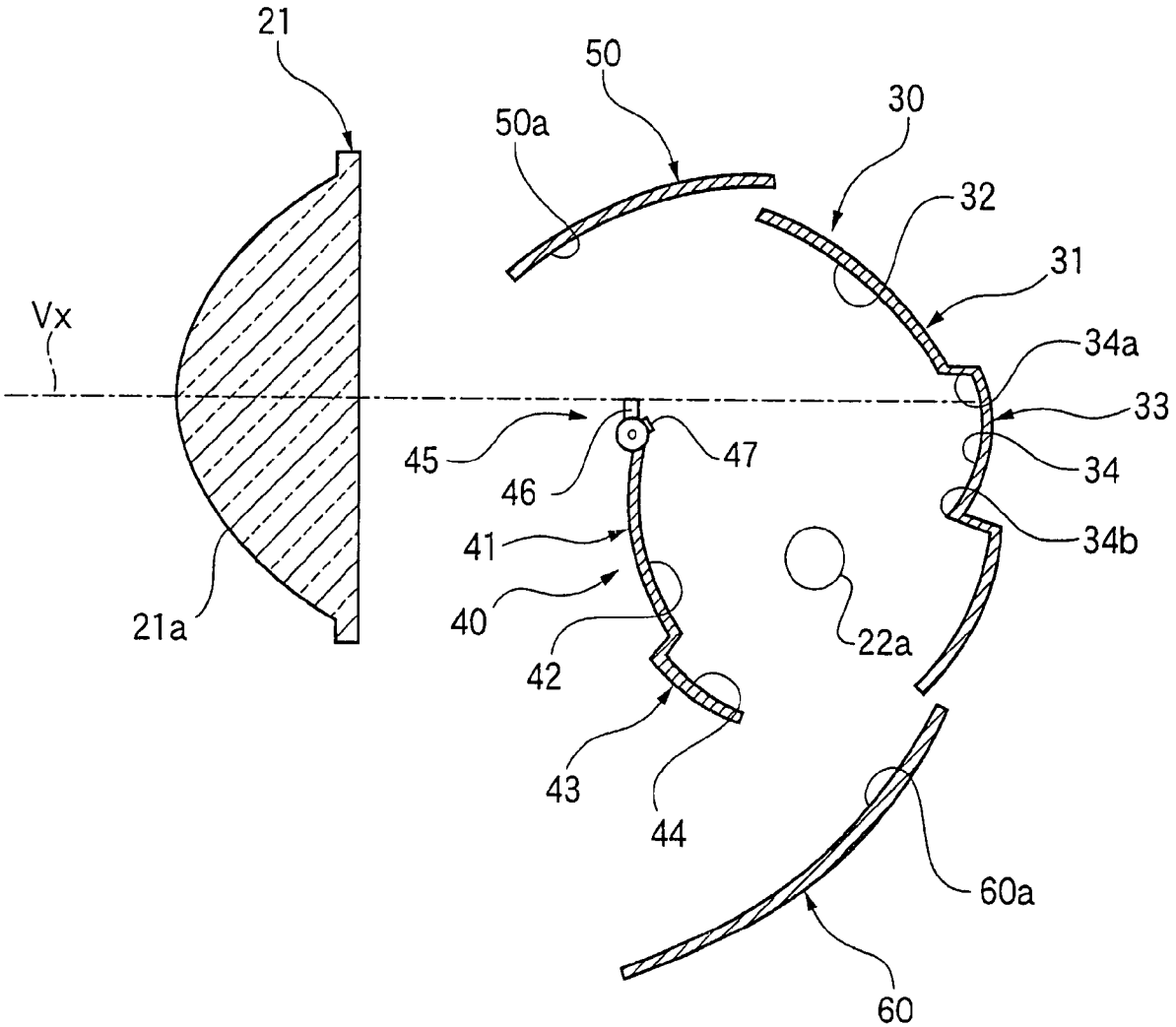
FIG. 7 is a sectional view taken in line A-B in FIG. 2 in the status of shade shielding.
Figure 8:
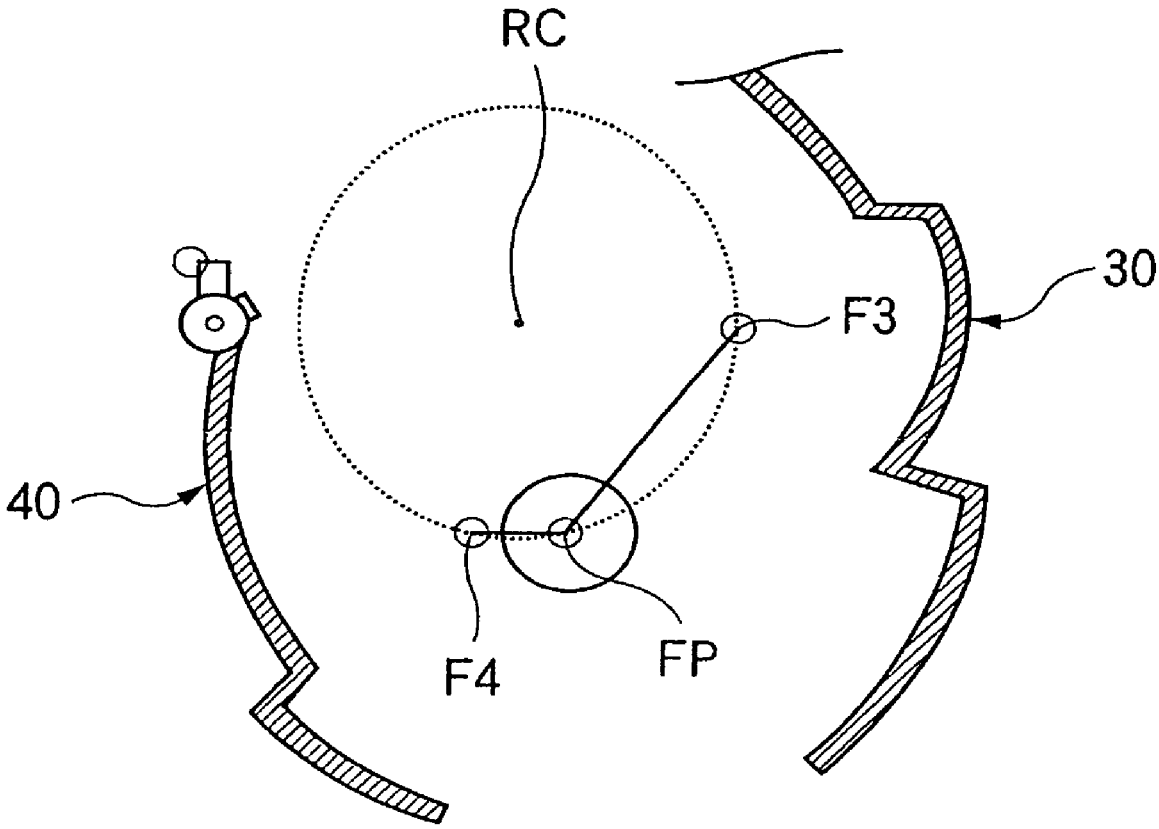
FIG. 8 is a partially enlarged longitudinal sectional view of the vehicle headlamp, which explains the positional relationship among focal points.
Figure 9:
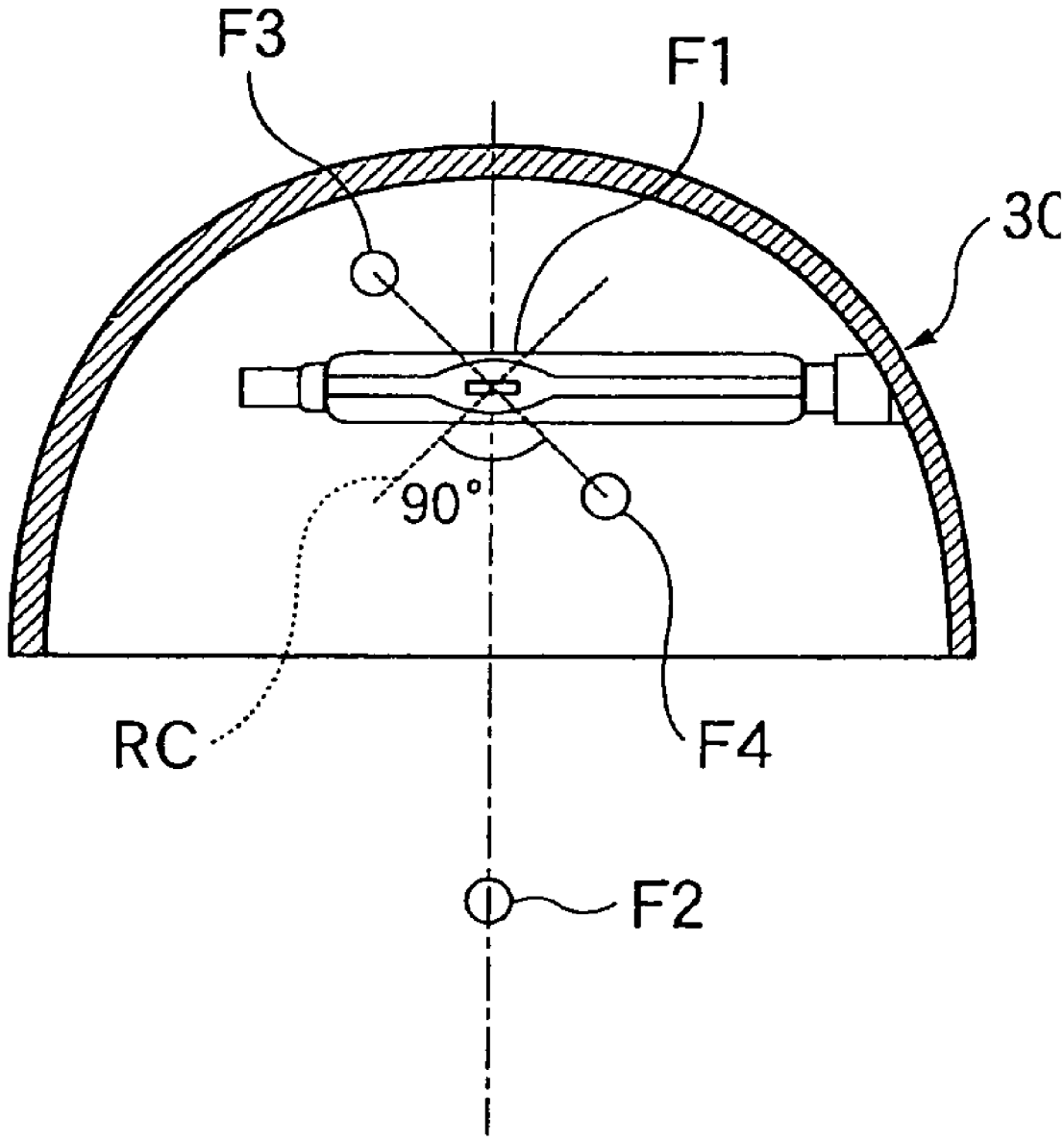
FIG. 9 is a partially enlarged longitudinal sectional view of the vehicle headlamp, which explains the positional relationship among focal points.
Figure 16:
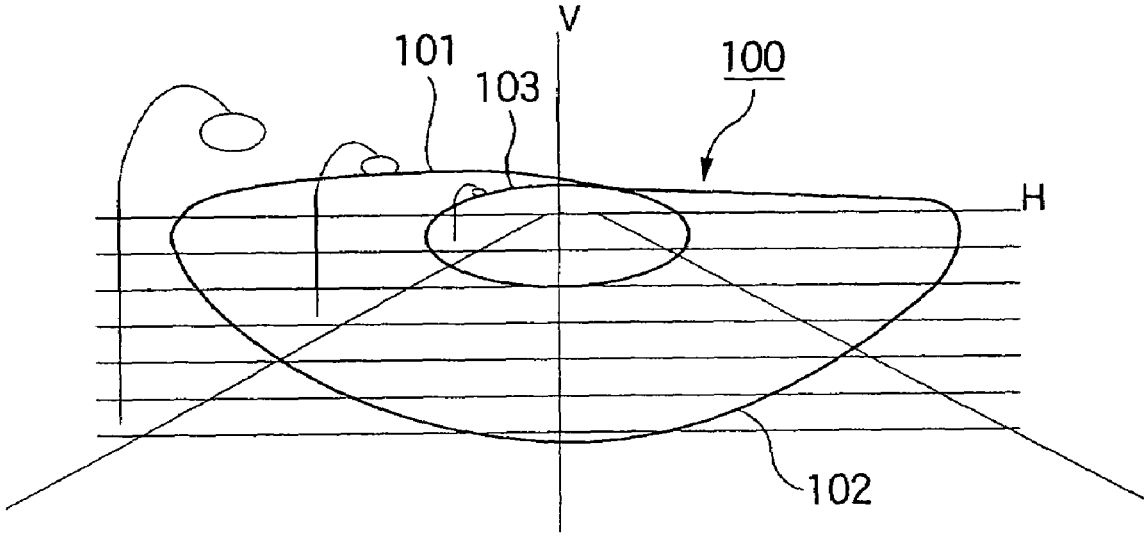
FIG. 16 is a view showing the distributed light pattern in a status of shade shielding.
Figure 17:
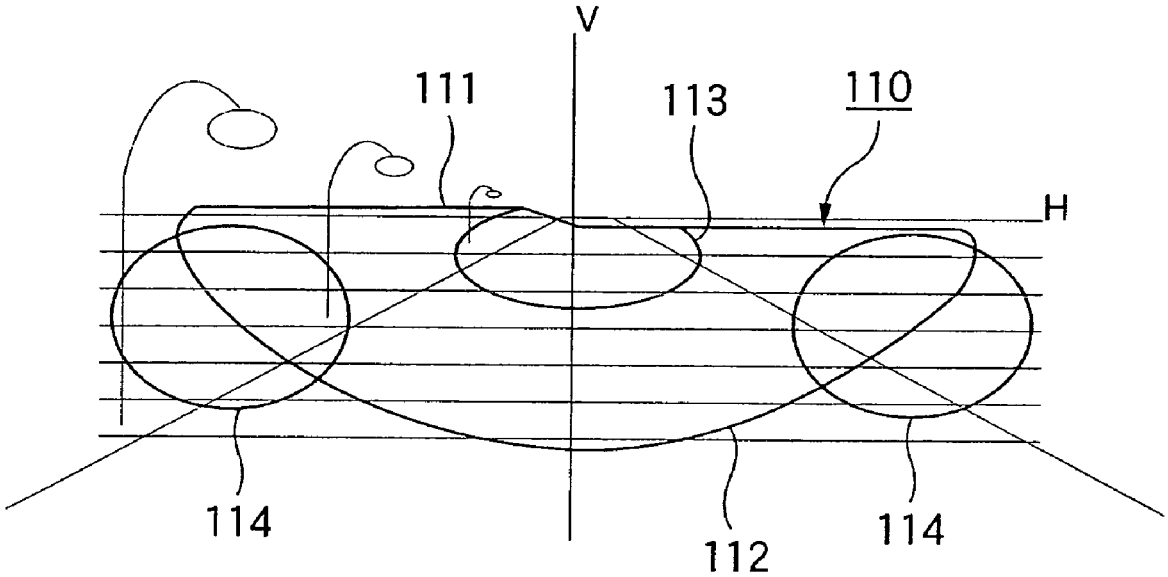
FIG. 17 is a view showing the distributed light pattern in a status of shade releasing.
Figure 18A:
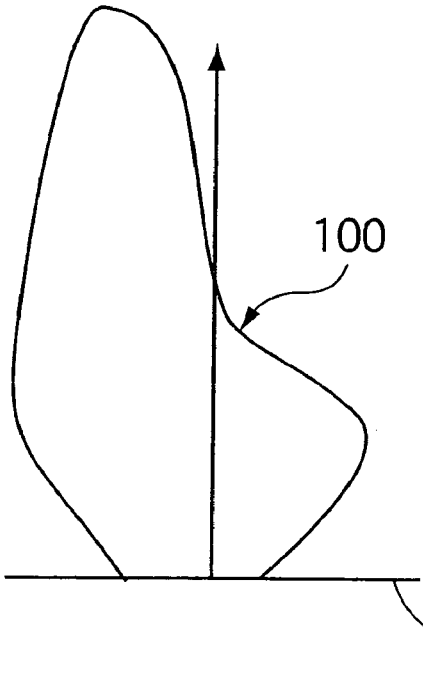
FIG. 18A shows the distributed light pattern in a status of shade shielding.
Figure 18B:
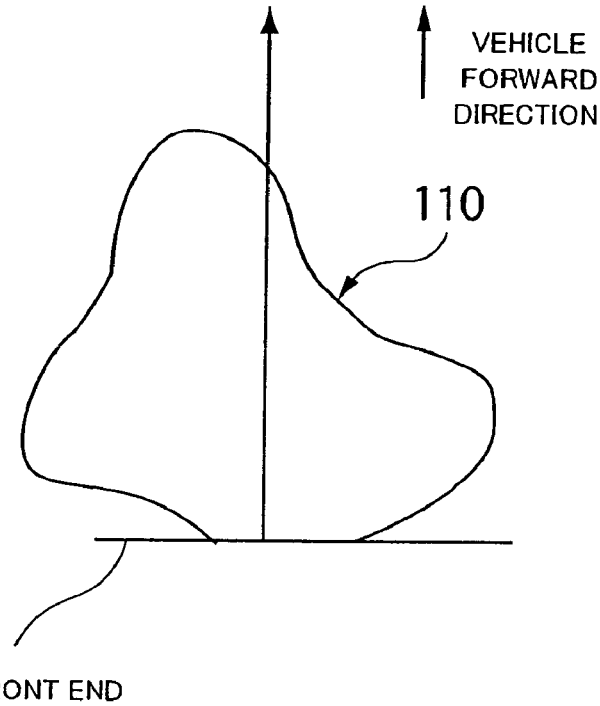
FIG. 18B shows the distributed light pattern in a status of shade releasing.

FIG. 1 is a view showing the vehicle headlamp according to an embodiment of this invention. FIG. 2 is a top view of the vehicle headlamp according to this embodiment. FIG. 3 is a sectional view taken in line III-III in FIG. 1. FIG. 4 is a sectional view taken in line A-A in FIG. 2 in a status of shade releasing. FIG. 5 is a sectional view taken in line A-B in FIG. 2 in a status of shade releasing. FIG. 6 is a sectional view taken in line A-A in FIG. 2 in a status of shade shielding. FIG. 7 is a sectional view taken in line A-B in FIG. 2 in the status of shade shielding. FIG. 8 is a partially enlarged longitudinal sectional view of the vehicle headlamp, which explains the positional relationship among focal points. FIG. 9 is a partially enlarged longitudinal sectional view of the vehicle headlamp, which explains the positional relationship among focal points. FIGS. 10 to 15 are light path diagrams of the vehicle headlamp. FIG. 16 is a view showing the distributed light pattern in a status of shade shielding. FIG. 17 is a view showing the distributed light pattern in a status of shade releasing. FIG. 18A shows the distributed light pattern in a status of shade shielding. FIG. 18B shows the distributed light pattern in a status of shade releasing.

As seen from FIG. 1, a vehicle headlamp 10 according to this embodiment is constructed of a lamp unit 20 arranged within a lamp room 10*a* which is defined by a lamp body 12 and a light transmissive cover 14 attached to cover the front opening of the lamp body 12.

The lamp unit 20 is a projector type of lamp unit attached to the lamp body 12 through an aiming mechanism not shown, which is designed so that the optical axis of the light emitted from the lamp unit 20 can be regulated by changing the attaching angle of the lamp unit 20 through the aiming mechanism.

The lamp unit 20, as seen from FIGS. 1 to 5, mainly includes a projector lens 21, a first sub-reflector 50, a rear reflector 30 provided with a main reflector 31 and a second sub-reflector 33, a third sub-reflector 60, and a front reflector 40 provided with a fourth sub-reflector 41 and a fifth sub-reflector 43.

In the following description, the respective components will be explained in the order of the projector lens 21, rear reflector 30, front reflector 40, first sub-reflector 50 and third sub-reflector 60.

First, the projector lens 21 will be explained.

The projector lens 21 is a lens having a convex lens plane 21*a* on the forward side in a longitudinal direction of a vehicle and a central axis Vx positioned so as to extend along the longitudinal direction of the vehicle. In the lamp unit 20 according to this embodiment, the projector lens 21 is arranged on the most forward side in the longitudinal direction of the vehicle. On the rearward side of the projector lens 21 in the longitudinal direction of the vehicle, the front reflector 40 and rear reflector 30 are arranged in this order. Above the horizontal plane including the central axis Vx of the projector lens 21, the first sub-reflector 50 is arranged; and below the horizontal plane including the central axis Vx of the projector lens 21, the third sub-reflector 60 is arranged.

Next, the rear reflector 30 will be explained.

The rear reflector 30, as seen from FIGS. 1 to 3, is a reflector in a nearly rotary elliptical shape having a front opening 30*a* on the forward side in the longitudinal direction of the vehicle and a lower opening 30*b* on the lower side. On the one side of the rear reflector 30 in the width direction of the vehicle, a though-hole 30*c* is formed in nearly parallel to the width direction of the vehicle. In the through-hole 30*c*, a light source bulb 22 is fixedly inserted from the outside of the rear reflector 30 to the inside thereof (FIG. 3).

The light source 22 is a discharge bulb such as a metal halide bulb which emits light from a light source 22*a* constructed of a discharge/light-emitting portion within a bulb tube 22*b*. As seen from FIG. 3, the light source bulb 22 is inserted so that its longitudinal direction has a gradient of 7° from parallelism to the width direction of the vehicle as required along the penetrating direction of the through-hole 30*c*. In addition, the light source bulb 22 is fixed so that the light source 22*a* is located on the vertical plane passing the central axis Vx of the projector lens 21.

The rear reflector 30 is integrally composed of the main reflector 31 having a main reflecting face 32 on the inside, i.e. on the forward side in the longitudinal direction and the second sub-reflector 33 having a second sub-reflecting face 34 on the same inside, i.e. on the forward side in the longitudinal direction. In this embodiment, the main reflector 31 and second sub-reflector 33 are integrally formed, but may be formed as separate bodies.

The main reflecting face 32 formed on the main reflector 31 is a reflecting face which occupies the greater part of the inside of the rear reflector 30 and has a nearly rotary elliptical shape at least as its vertical sectional shape. The light source 22*a* of the light source bulb 22, as seen from FIG. 4, is arranged in the vicinity of a first focal point (point F1) when the main reflecting face 32 is approximated as the rotary elliptical shape. The main reflecting face 32 reflects the light emitted from the light source 22*a* so that it is collected in the vicinity of the second focal point (point F2). The points in the vicinity of the first focal point (point F1) and second focal point (point F2) of the main reflecting face 32 are arranged in the vertical plane passing the central axis Vx of the projector lens 21. The rear focal point of the projector lens 21 is arranged so as to nearly agree with the second focal point (point F2) of the main reflecting face 32.

Further, as seen from FIGS. 2 and 4, of the inner peripheral surface of the rear reflector 30, the main reflecting face 32 is formed in the vicinity of plane intersecting the vertical plane at least passing the central axis Vx of the projector lens 21.

The second sub-reflecting face 34 formed on the second sub-reflector 33 is a reflecting face which is partially formed on both sides of the inner face of the rear reflector 30 and has a nearly rotary elliptical shape at least as its vertical sectional shape. On the inner peripheral surface of the rear reflector 30, an upper concave 34*a* and a lower convex 34*b* are formed on both sides not intersecting the vertical plane passing the central axis Vx of the projector lens 21 in FIG. 2. The curved face coupling the concave 34*a* and convex 34*b* constitutes the second sub-reflecting face 34.

Next, the front reflector 40 will be explained.

As seen from FIGS. 1 and 2, the front reflector 40 is attached to cover the lower part of the forward opening 30*a* of the rear reflector 30. At the upper portion of the front reflector 40, an opening 40*a* defined by an upper end 40*b* is made. The upper end 40*b* is located below the central axis Vx of the projector lens 21. Nearly above the upper end 40*b*, the second focal point (point F2) of the main reflecting face 32 is located. On the upper end 40*b* of the front reflector 40, a rotary shade 45 is arranged.

The rotary shade 45 includes a cylindrical body 45*a* whose axis is oriented in the width direction of the vehicle and two shades 46, 47 arranged circumferentially apart from each other on the surface of the body 45*a*. The body 45*a* is designed to be rotatable along a rotary shaft 45*b* so that as seen from FIGS. 4 and 6 or FIGS. 5 and 7, the two shades 46, 47 can be selectively positioned upward in the vertical direction.

The shade 46 and the shade 47 are set so that their shade upper end face when they are positioned upward in the vertical direction is situated in the vicinity of the second focal point (point F2) of the main reflecting face 32. Thus, the shades 46, 47 shield a part of the light reflected by the main reflecting face 32 and going to the point F2 and cause the remaining part to be incident on the projector lens 21. In this way, the shades 46, 47 form cut-off lines corresponding to the respective shapes of the shade upper end faces of the shades 46, 47 on the distributed light patterns forward projected. Now, it is assumed that the shade 46 and shade 47 have different lengths protruding from the body 45*a*. As shown in comparison in FIGS. 4 and 6, the shade 46 is located at a higher position than the shade 47 in their upper end face and so the shade 46 protrudes more upward than the shade 47 does. For this reason, the shade 46 shields a larger quantity of light than the shade 47 to lower the cut-off line projected forward. In the following description, the status in which the shade 46 is oriented to the vertical direction is called "shade shielding status, whereas the status in which the shade 47 is oriented to the vertical direction is called "shade releasing status".

The front reflector 40 has a fourth sub-reflector 41 having a fourth sub-reflecting face 42 on the inside, i.e. at a part of the rearward side in the longitudinal direction of the vehicle.

The fourth sub-reflecting face 42 is a reflecting face which is formed to be located at a position ahead of the light source 22*a* in the longitudinal direction of the vehicle and has a nearly rotary elliptical shape.

Further, a fifth sub-reflector 43 having a fifth sub-reflecting face 44 with a free curve shape is formed integrally to the lower portion of the fourth sub-reflector 41. This fifth sub-reflecting face 44 formed on the fifth sub-reflector 43 reflects the incident light from the light source 22*a* toward the vicinity of the light source 22*a* so that the light emitted from the light source 22*a* is returned to the vicinity of the light source 22*a* and emitted in another direction, thereby reducing the non-used light not projected forward and increasing the quantity of light projected forward.

Next, the first sub-reflector 50 will be explained.

As seen from FIGS. 1 and 2, the first sub-reflector 50 is a reflector provided above the front reflector 40. The first sub-reflector 50 has a first sub-reflecting face 51 with a nearly rotary elliptical shape at least as its vertical sectional shape formed on the lower surface of the first sub-reflector 50. This sub-reflecting face 51 downward reflects the light from the light source 22*a*.

The first sub-reflector 50 is designed to be rotatable around a rotary center axis RC by a driving member not shown. For example, the first sub-reflector 50 is designed to be displaceable from a first position where the first sub-reflecting face 51 is oriented obliquely as shown in FIG. 4 to a second position where the first sub-reflecting face 51 is oriented more obliquely downward as shown in FIG. 6. As shown in comparison in FIGS. 4 and 6 or FIGS. 5 and 7, in the shade shielding status, the first sub-reflector 50 is situated at the first position whereas in the shade releasing status, the first sub-reflector 50 is situated at the second position.

Next, the third sub-reflector 60 will be explained.

As seen from FIG. 4, the third sub-reflector 60 is a reflector arranged below the lower opening 30*b* of the rear reflector 30. The third sub-reflector 60 has a third sub-reflecting face 61 with a nearly parabolic shape as at least its vertical sectional shape formed on the upper surface of the third sub-reflector 60. Thus, the third sub-reflector 60 forward projects, not through the projector lens 21, the light reflected by the third sub-reflecting face 61 through the lower opening 30*b*.

An explanation will be given of the relative optical positional relationship among the main reflecting face 32, first sub-reflecting face 51, second sub-reflecting face 34, third sub-reflecting face 61 and fourth sub-reflecting face 42.

The fourth sub-reflecting face 42 when it is approximated as the rotary elliptical shape is designed so that its first focal point nearly agrees with the light source 22*a*, i.e. the first focal point of the main reflecting face 32 and its second focal point (point F3) nearly agrees with the first focal point of the second sub-reflecting face 34. For this reason, the light reflected by the fourth sub-reflecting face 42 is incident on the second sub-reflecting face 34 in a status where the light collecting optical system of the light incident from the light source 22*a* is kept.

The second sub-reflecting face 34 when it is approximated as the rotary elliptical shape is designed so that its first focal point nearly agrees with the second focal point (point F3) of the fourth sub-reflecting face 42 and its second focal point nearly agrees with the second focal point (point F2) of the main reflecting face 32, i.e. the rear focal point of the projector lens 21. For this reason, the second sub-reflecting face 34 reflects the light incident from the fourth sub-reflecting face 42 toward the second focal point (point F2) of the main reflecting face 32. The light come to the point F2 is selectively shielded by the shade 46 or shade 47 and projected forward by the projector lens 21.

In either case where the sub-reflector 50 is situated the first point as shown in FIG. 4 or the second position as shown in FIG. 6, the first sub-reflecting face 51 is designed so that its first focal point when the fourth sub-reflecting face 42 is approximated as the rotary elliptical shape nearly agrees with the light source 22*a*, i.e. first focal point (point F1) of the main reflecting face 32. On the other hand, the second focal point of the first sub-reflecting face 51 changes according to the position of the first sub-reflector 50.

Concretely, the first sub-reflecting face 50 is situated at the first position shown in FIGS. 4 and 5, the second focal point of the first sub-reflecting face 51 nearly agrees with the first focal point of the second sub-reflecting face 34 and the second focal point of the fourth sub-reflecting face 42, i.e., point F3. Therefore, when the first sub-reflector 50 is situated at the first position shown in FIGS. 4 and 5, the light reflected by the third reflecting face 61 is incident on the second sub-reflecting face 34 through the first focal point (point F3) of the second sub-reflecting face 34, and is reflected toward the second focal point (point F2) from the second sub-reflecting face 34. The light come to the point F2 is selectively shielded by the shade 47, and projected forward by the projector lens 21.

On the other hand, the first sub-reflector 50 is situated at the second position shown in FIGS. 6 and 7, the second focal point of the first sub-reflecting face 51 is located so that the it nearly agrees with the focal point (point F4) of the third sub-reflecting face 61 of the third sub-reflector 60.

Therefore, when the first sub-reflector 50 is situated at the second position shown in FIGS. 6 and 7, the light reflected by the third reflecting face 61 is incident on the first sub-reflecting face 51 through the focal point (point F4) of the third sub-reflecting face 61 and reflected forward as parallel light by the first sub-reflecting face 51.

The first sub-reflector 50 satisfies the above conditions when it satisfies the following condition.

(a) The points F1, F3 and F4 do not reside on the same straight line (see FIG. 8).

(b) The points F1, F3 and F4 reside on the same plane (see FIG. 9).

(c) The straight line which passes the center of the circle including the points F1, F3 and F4 and crosses the circle at right angles agrees with the rotary axis RC of the first sub-reflector 50 (see FIGS. 8 and 9).

By rotating the first sub-reflector 50 around the rotary axis RC, with the points F1, F3, F4 and rotary axis RC being set so as to satisfy the above condition, it is possible to fix the first focal point of the first sub-reflector 50 at the point F1 and also change its second focal point from the point F3 to the point F4.

Next, referring to FIGS. 10 to 18B, an explanation will be given of switching of the distributed light pattern by the vehicle headlamp 10 provided with the lamp unit 20 according to this embodiment, light paths within the lamp unit 20 and distributed light patterns to be formed.

First, referring to FIGS. 10, 12 and 13, the light path during the shade releasing will be explained. During the shade releasing, the shade 47 is oriented in the vertical direction and the first sub-reflector 50 is situated at the first position.

Figure 10:
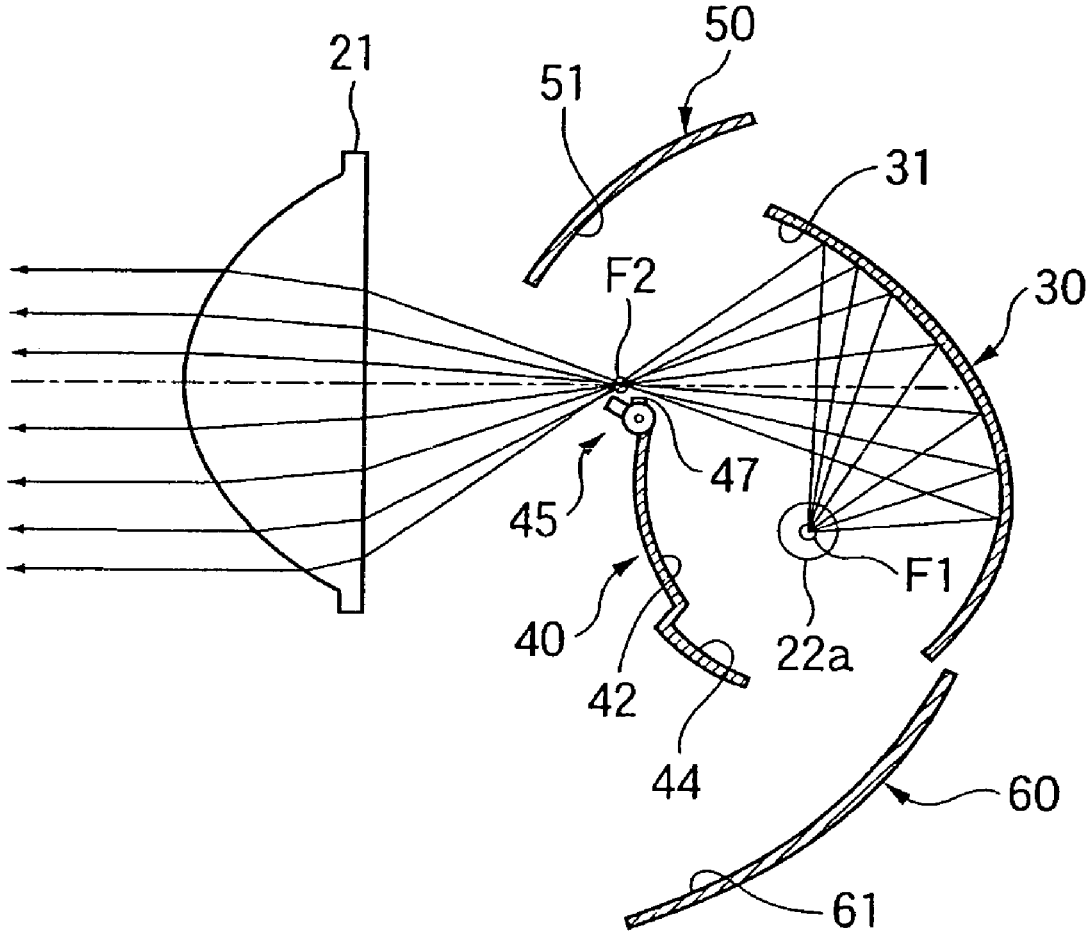
FIG. 10 is a light path diagram of the vehicle headlamp.

As seen from FIG. 10, the light come from the light source 22*a* to the main reflecting face 32 of the rear reflector 30 is reflected by the main reflecting face 32 toward the vicinity of the second focal point (point F2) of the main reflecting face 32. The light come to the point F2 is partially shielded according to the shape of the upper end face of the shade 47, incident on the projector lens 21 through the point F2 and projected forward by the projector lens 21.

Figure 12:
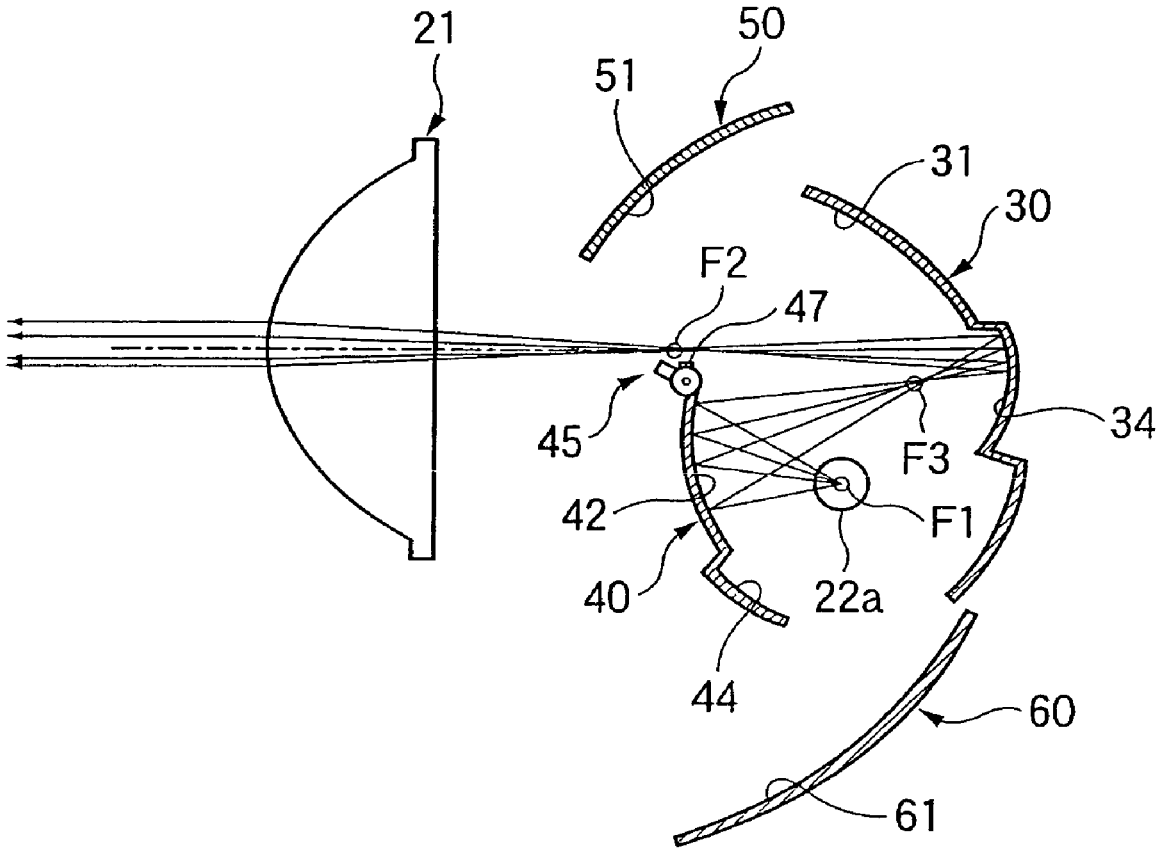
FIG. 12 is a light path diagram of the vehicle headlamp.

Further, as seen from FIG. 12, the light incident on the fourth sub-reflecting face 42 of the front reflector 40 from the light source 22*a* is incident on the second sub-reflecting face 34 of the rear reflector 30 through the vicinity of the second focal point (point F3) of the fourth sub-reflecting face 42 and reflected toward the vicinity of the second focal point (point F2) of the second sub-reflecting face 34. The light come to the point F2 is partially shielded according to the upper end face shape of the shade 47, incident on the projector lens 21 through the point F2 and projected forward by the projector lens 21.

Figure 13:
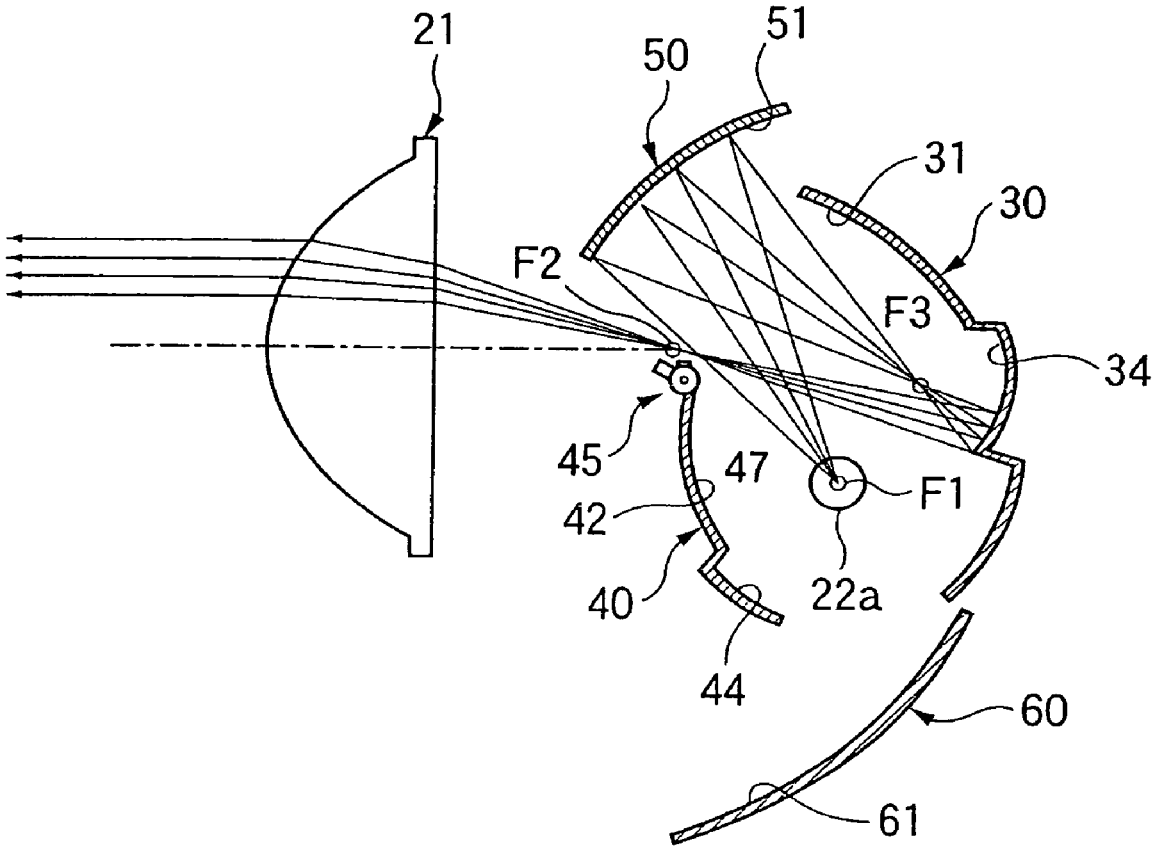
FIG. 13 is a light path diagram of the vehicle headlamp.

Further, as seen from FIG. 13, the light incident on the first sub-reflecting face 51 of the first sub-reflector 50 from the light source 22*a* is incident on the second sub-reflecting face 34 of the rear reflector 30 through the second focal point (point F3) of the first sub-reflecting face 51 at the first position, and reflected toward the vicinity of the second focal point (point F2) of the second sub-reflecting face 34. The light come to the point F2 is partially shielded according to the upper end face shape of the shade 47, incident on the projector lens 21 through the point F2 and projected forward by the projector lens 21.

A distributed light pattern 100 formed during the shade releasing, as seen from FIG. 16, includes a basic distributed light region 102 with a cut-off line 101 located above the H line formed by the main reflecting face 32 and a spot region 103 superposed thereon which is projected forward through the fourth sub-reflecting face 42 or first sub-reflecting 51 and the second sub-reflecting face 34 on the region where the H line and V line on the basic distributed light region 102 intersect.

This light pattern 100, in which intense collected light is projected onto the region where the H line and V line intersect, can be used as "motor way distributed light" for illuminating a distant place on a vehicle dedicated road as shown in FIG. 18A.

Next, referring to FIGS. 11, 14 and 15, the light path during the shade shielding will be explained. During the shade shielding, the shade 46 is oriented in the vertical direction and the first sub-reflector 50 is situated at the second position.

Figure 11:
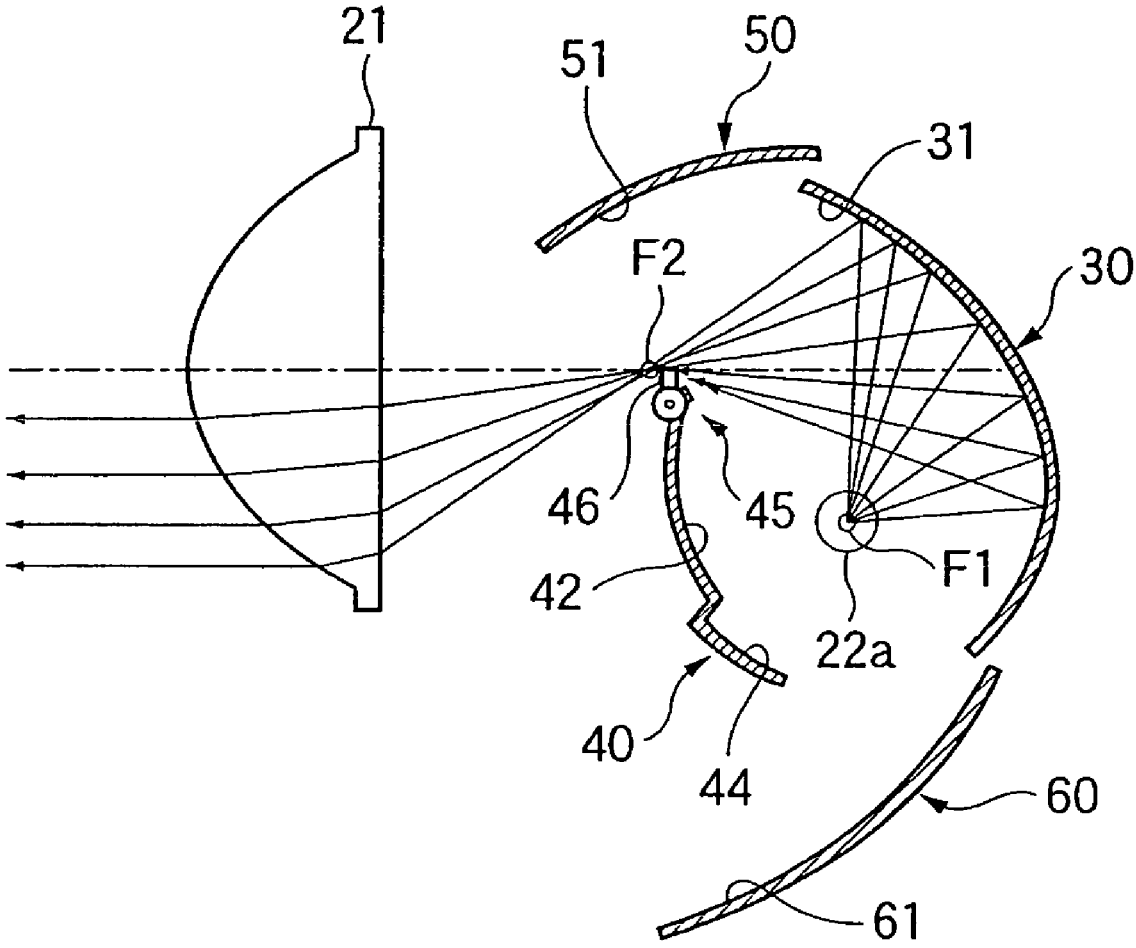
FIG. 11 is a light path diagram of the vehicle headlamp.

As seen from FIG. 11, the light incident on the main reflecting face 32 of the rear reflector 30 from the light source 22*a* is reflected by the main reflecting face 32 toward the vicinity of the second focal point (point F2) of the main reflecting face 32. The light come to the point F2 is partially shielded by the upper end face shape of the shade 46, incident on the projector lens 21 through the point F2 and projected forward by the projector lens 21. The shade 46, which projects more upward than the shade 47, shields a larger quantity of light than the shade 47, and lowers the cut-off line of the distributed light pattern projected forward.

Figure 14:
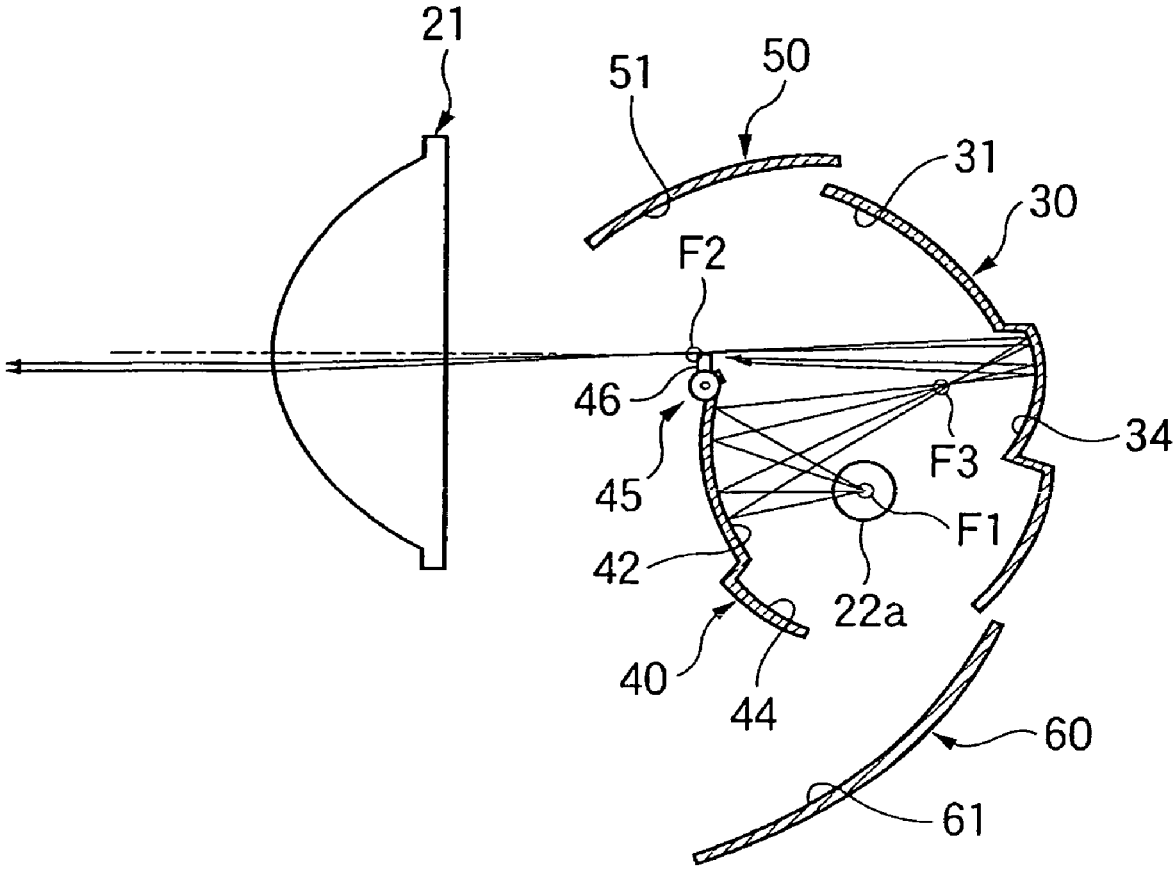
FIG. 14 is a light path diagram of the vehicle headlamp.

Further, as seen from FIG. 14, the light incident on the fourth sub-reflecting face 42 of the front reflector 40 from the light source 22*a* is incident on the second sub-reflecting face 34 of the rear reflector 30 through the vicinity of the second focal point (point F3) of the fourth sub-reflecting face 42 and reflected toward the vicinity of the second focal point (point F2) of the second sub-reflecting face 34. The light come to the point F2 is partially shielded according to the upper end face shape of the shade 47, incident on the projector lens 21 through the point F2 and projected forward by the projector lens 21. In this case also, the shade 46, which projects more upward than the shade 47, shields a larger quantity of light than the shade 47.

Figure 15:
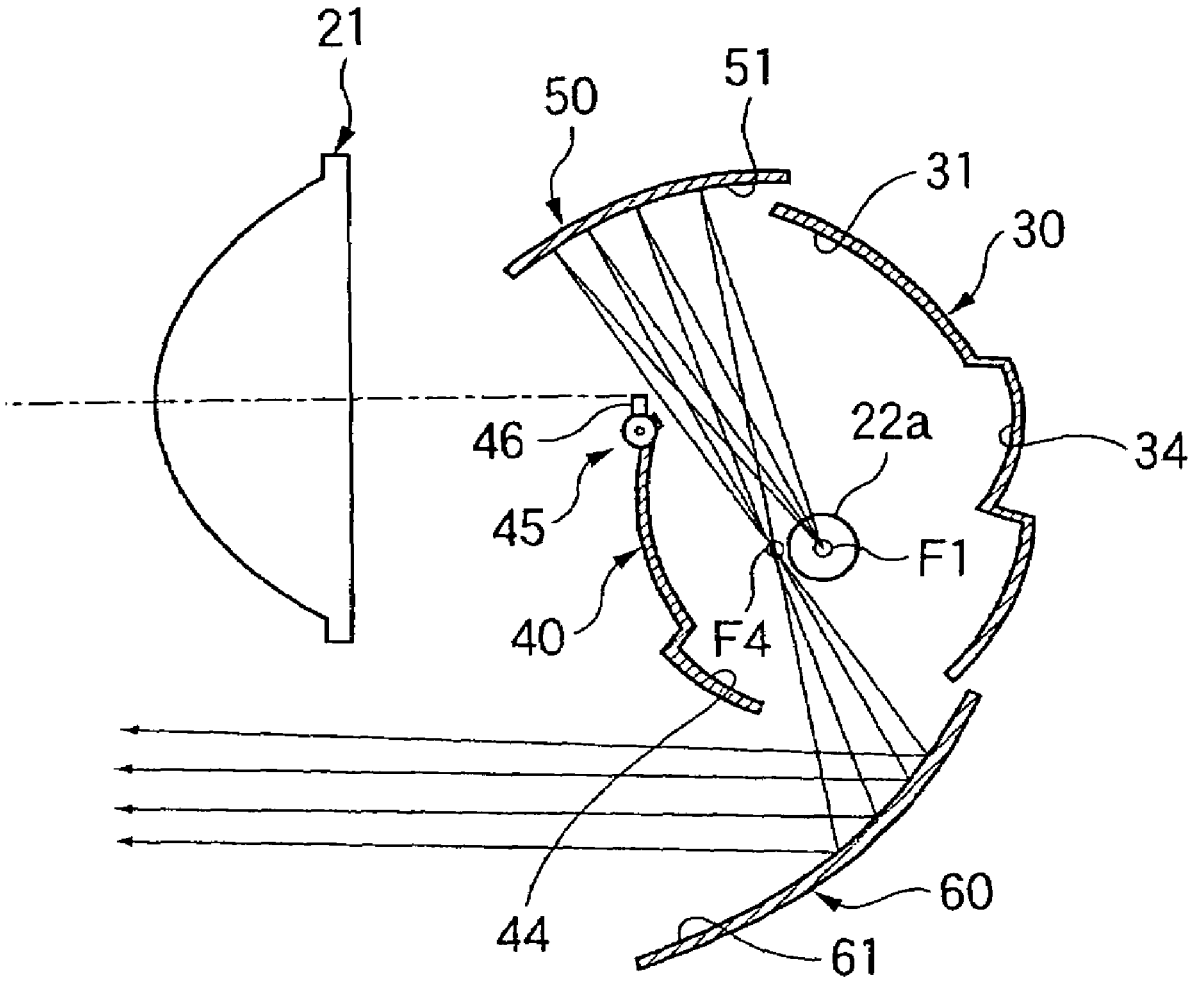
FIG. 15 is a light path diagram of the vehicle headlamp.

Further, as seen from FIG. 15, the light incident on the first sub-reflecting face 51 of the first sub-reflector 50 from the light source 22*a* is reflected by the third sub-reflecting face 61 of the third reflector 60 through the vicinity of the second focal point (point F4) of the first sub-reflecting face 51 at the second position, and forward projected not through projector lens 21.

A distributed light pattern 110 formed during the shade shielding, as seen from FIG. 17, includes a basic distributed light region 112 with a cut-off line 111 located above H line formed by the main reflecting face 32, a spot region 113 superposed thereon which is projected forward through the fourth sub-reflecting face 42 and the second sub-reflecting face 34 in the vicinity of the lower portion of the region where H line and V line on the basic distributed light region 112 intersect, and diffused regions 114 superposed on both sides of the basic distributed light pattern 112 which are forward projected through the first sub-reflecting face 51 and the third sub-reflecting face 61.

Since the upper end face of the shade 46 is nearer to the second focal point (point F2) of the main reflecting face 32 than the upper end face of the shade 47, the distributed light pattern 110 gives the cut-off line 111 that is clear, and improves distant place visibility by the spot region 113.

In addition, superposition of the diffused regions 114 increases the quantity of light in the lateral direction as shown in FIG. 18B, thereby improving lateral visibility. In short, the distributed light pattern 110 gives an increased quantity of light below the cut-off line 111.

As understood from the description hitherto made, the vehicle headlamp 10 according to this embodiment has a lamp unit 20 arranged within a lamp room 10*a* constructed by a lamp body 12 and a cover 14. The lamp unit 20 includes a light source bulb 22 having a light source 22*a* for emitting light, a main reflector 31 provided with the main reflecting surface 32 for reflecting the light emitted from the light source 22*a*, a shade 46, 47 for shielding a part of the light reflected by the main reflecting face 32 and a projector lens 21 for forward projecting the light having passed the shade 46, 47. The vehicle headlamp 10 according to this embodiment further includes a first sub-reflector 50 having a first sub-reflecting face 51 for reflecting the light emitted from the light source 22*a*, the first sub-reflector 50 being movable; a second sub-reflector 33 having a second sub-reflecting face 34 for forward projecting the light from the first sub-reflector 50 through the shade 47 and the projector lens 21 when the first sub-reflector 50 is situated at the first position; and a third sub-reflector 60 having a third sub-reflecting face 61 for forward projecting the light from the first sub-reflector 50 not through the projector lens 21 when the first sub-reflector 50 is situated at the second position.

In accordance with this embodiment, the region to be illuminated can be changed between when the light incident on the first sub-reflecting face 51 of the first sub-reflector 50 is reflected at the first position and when it is reflected at the second position. For this reason, as the occasion demands, by appropriately forward projecting the light incident on the first sub-reflecting face 50, a suitable distributed light pattern can be adaptively formed. Concretely, as in this embodiment, by forming the collected light when the first sub-reflector 50 is situated at the first position and the diffused light when the first sub-reflector 50 is situated at the second position, as the occasion demands, the quantity of light below the H line can be increased, thereby realizing larger quantity of light, or the collected light with sufficient quantity of light can be collected to the vicinity of the H-V.

Further, in this embodiment, a fourth sub-reflector 41 having the fourth sub-reflecting face 42 is provided for reflecting the light emitted from the light source 22*a* toward the second sub-reflector 34, and the second sub-reflecting face 34 forward projects the light from the fourth sub-reflecting face 42 through the shade 46, 47 and the projector lens 21.

For this reason, in accordance with this embodiment, the light from the light source 22*a* not projected onto the main reflecting face 32 can be picked up by the fourth sub-reflecting face 42 and second sub-reflecting face 34 so that it can appropriately projected forward. Thus, the quantity of light projected forward is increased, thereby providing a brighter vehicle headlamp. Particularly, in this embodiment, the light picked up by the fourth sub-reflecting face 42 and the second sub-reflecting face 34 is collected as the collected light with a sufficient quantity of light in the vicinity of the H-V. Thus, the quantity of light can be increased in the vicinity of the center of the distributed light pattern, thereby enhancing the distant place visibility.

Further, in this embodiment, the movable shade 45 equipped with two shades 46, 47 is provided. This movable shade 45 selects the shade 46 or shade 47 according to the position of the first sub-reflector 50 to change the height of its upper end face. Thus, by lowering the height of the shade upper end face, the light can be projected above the H line, thereby realizing the "motor way distributed light" with the distant place visibility.

Concretely, the height of the upper end face of the movable shade 45 is lower when the first sub-reflector 50 is situated at the first position than it is situated at the second position.

In accordance with such a configuration, where the shade upper end face is lowered, the collected light is formed by the fourth sub-reflecting face 42 and second sub-reflecting face 34. In addition, the collected light formed by the first sub-reflecting face 51 and the third sub-reflecting face 61 is collected in the vicinity of H-V, thereby enhancing the motor high distributed light with the distant place visibility.

Inversely, where the shade upper end face is raised, the collected light is formed by the fourth sub-reflecting face 42 and second sub-reflecting face 34. In addition, the diffused light is formed by the first sub-reflecting face 51 and the third sub-reflecting face 61 to form the distributed light pattern with a large quantity of light below the H line, thereby realizing the distributed light with the lateral visibility.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle headlamp comprising:

a light source bulb having a light source for emitting light;

a main reflector that reflects the light emitted from the light source;

a shade that shields a part of the light reflected by the main reflector;

a projector lens that forward projects the light passing the shade;

a first sub-reflector that reflects the light emitted from the light source, the first sub-reflector being movable;

a second sub-reflector that forward reflects the light from the first sub-reflector through the shade and the projector lens when the first sub-reflector is located in a first position; and a third sub-reflector that forward projects the light from the first sub-reflector not through the projector lens when the first sub-reflector is located in a second position, wherein the first sub-reflector is arranged above the horizontal plane including a central axis of the projector lens; and the third sub-reflector is arranged below the horizontal plane.

2. The vehicle headlamp according to claim 1, further comprising:

a fourth sub-reflector that reflects the light emitted from the light source toward the second sub-reflector, wherein the second sub-reflector forward projects the light from the fourth sub-reflector through the shade and the projector lens.

3. The vehicle headlamp according to claim 1, wherein the shade changes a height of its upper end face according to the position of the first sub-reflector; and the height of the upper end face of the shade is lower when the first sub-reflector is located in the first position than the height of the upper end face of the shade when the first sub-reflector is located in the second position.

4. The vehicle headlamp according to claim 1, wherein the second sub-reflector is integrally formed with the main reflector, and the second sub-reflector does not intersect a plane including the light source and a central axis of the projector lens.

5. The vehicle headlamp according to claim 1, further comprising:

a fourth sub-reflector that reflects the light emitted from the light source toward the second sub-reflector, wherein the second sub-reflector forward projects the light from the fourth sub-reflector through the shade and the projector lens, wherein the shade changes a height of its upper end face according to the position of the first sub-reflector, the height of the upper end face of the shade is lower when the first sub-reflector is located in the first position than the height of the upper end face of the shade when the first sub-reflector is located in the second position, the second sub-reflector is integrally formed with the main reflector, and the second sub-reflector does not intersect a plane including a central axis of the projector lens, the first sub-reflector is arranged above the horizontal plane including the central axis, and the third sub-reflector is arranged below the horizontal plane.

6. The vehicle headlamp according to claim 1, wherein the main reflector includes a main reflecting surface and the second sub-reflector is discontinuous with the main reflecting surface.

7. The vehicle headlamp according to claim 1, wherein the light source comprises a discharge bulb, and wherein the light source is located in a lower side of a central axis of the projector lens.

8. The vehicle headlamp according to claim 1, wherein a longitudinal direction of the light source bulb has a gradient of 7° from parallelism to a width direction of a vehicle.

9. The vehicle headlamp according to claim 1, wherein the second sub-reflector is positioned between the first sub-reflector and the third sub-reflector in a vertical direction.

10. The vehicle headlamp according to claim 1, wherein a longitudinal direction of the light source bulb is inclined with respect to a width direction of a vehicle.

* * * * *